US008388314B2

(12) United States Patent
McCallum

(10) Patent No.: US 8,388,314 B2
(45) Date of Patent: Mar. 5, 2013

(54) TURBINE INLET CASING WITH INTEGRAL BEARING HOUSING

(75) Inventor: Martel Alexander McCallum, Greenville, SC (US)

(73) Assignee: General Electric Company, Schenectady, NY (US)

( * ) Notice: Subject to any disclaimer, the term of this patent is extended or adjusted under 35 U.S.C. 154(b) by 34 days.

(21) Appl. No.: 13/091,176

(22) Filed: Apr. 21, 2011

(65) Prior Publication Data

US 2012/0269612 A1 Oct. 25, 2012

(51) Int. Cl.
*F01D 25/14* (2006.01)

(52) U.S. Cl. ..... 415/214.1; 415/1; 415/229

(58) Field of Classification Search ..... 415/1, 214.1, 415/215.1, 220, 221, 229
See application file for complete search history.

(56) References Cited

U.S. PATENT DOCUMENTS

| | | | | |
|---|---|---|---|---|
| 3,902,314 | A | 9/1975 | Straniti | |
| 3,976,165 | A * | 8/1976 | Pilarczyk | 184/6.16 |
| 4,076,452 | A * | 2/1978 | Hartmann | 60/797 |
| 5,094,588 | A * | 3/1992 | Gros | 415/213.1 |
| 5,108,258 | A * | 4/1992 | Gros | 415/213.1 |
| 5,326,222 | A * | 7/1994 | Matyscak et al. | 415/213.1 |
| 6,030,176 | A * | 2/2000 | Oeynhausen | 415/214.1 |
| 2003/0120415 | A1 | 6/2003 | Seeley et al. | |
| 2003/0170118 | A1 * | 9/2003 | Matyscak et al. | 415/170.1 |
| 2006/0039782 | A1 | 2/2006 | Martin et al. | |
| 2010/0178161 | A1 | 7/2010 | Flanagan et al. | |
| 2010/0296911 | A1 | 11/2010 | McCallum et al. | |
| 2010/0296912 | A1 | 11/2010 | McCallum et al. | |

FOREIGN PATENT DOCUMENTS

JP 59-122706 * 7/1984

OTHER PUBLICATIONS

Hatano, Steam Turbine, Jul. 16, 1984, Abstract of JP59-122706.*

* cited by examiner

*Primary Examiner* — Edward Look
*Assistant Examiner* — Liam McDowell
(74) *Attorney, Agent, or Firm* — Sutherland Asbill & Brennan LLP

(57) ABSTRACT

A compressor inlet casing comprising an inner bellmouth and a bearing housing. The bearing housing may include an integrally cast first half connected to the inner bellmouth and a cavity positioned between the inner bellmouth and the integrally cast first half of the bearing housing.

19 Claims, 5 Drawing Sheets

TURBINE INLET CASING WITH INTEGRAL BEARING HOUSING

TECHNICAL FIELD

The present application and the resultant patent relate generally to gas turbine engines and more particularly relate to a compressor inlet casing with an integrally cast bearing housing half so as to accommodate thermal growth therein without impact on the position of the rotor shaft.

BACKGROUND OF THE INVENTION

Generally described, the turbine section and the compressor section of a gas turbine engine are coupled via a rotor shaft. A number of circumferentially spaced rotor blades may be attached to the rotor shaft in both sections. The rotor blades in the turbine section are driven by hot combustion gases. The rotor shaft in turn drives the rotor blades in the compressor section so as to provide compressed air. Because the casing of the compressor may have a different thermal response time than the rotor wheel or rotor blades therein, the rotor blade tips may expand at a different rate than the casing so as to create the potential for the rotor blades to rub against the casing. Such rubbing may cause early rotor blade damages and possible failure. As a result, operational rotor blade/casing clearances must accommodate these differing expansion rates. These increased clearances may limit the efficiency of the overall gas turbine engine.

Current compressor inlet casing designs generally incorporate either a separate bearing housing in an inner barrel or the inner bellmouth or may have an integrally cast bearing housing that is machined into a solid inner bellmouth lower half. The bearing housing includes a number of bearing pads positioned about the rotor shaft for support during rotation thereof.

During operation, the integrally cast lower half bearing housing may expand due to the temperature of the bearing lubricating oil so as to rise vertically relative to the centerline of the inner bellmouth. This expansion is due in part to the asymmetric mass and the stiffness of the integrally cast lower half bearing housing. The thermal rise of the bearing housing is not desirable because it may push the rotor shaft off center. The integrally cast bearing housing, however, is cheaper as compared to a separate bearing housing. Greater clearances thus may be required so as to avoid casing rubbing.

There is a desire therefore for an improved compressor inlet casing design so as to reduce or eliminate the impact of thermal expansion on an integrally cast bearing housing. Preferably such an improved design would maintain the rotor shaft in position so as to allow tighter clearances about the casing and the rotor blades for an increase in overall system efficiency.

SUMMARY OF THE INVENTION

The present application and the resultant patent thus provide a compressor inlet casing. The compressor inlet casing may include an inner bellmouth and a bearing housing. The bearing housing may include an integrally cast first half connected to the inner bellmouth and a cavity positioned between the inner bellmouth and the integrally cast first half of the bearing housing.

The present application and the resultant patent further provide a method of operating a compressor. The method may include the steps of integrally casting a first half of a bearing housing in a compressor inlet casing, rotating a rotor shaft within the bearing housing, extending a lubricating oil conduit about the bearing housing, and thermally expanding the bearing housing within a cavity extending between the bearing housing and the compressor inlet casing.

The present application and the resultant patent further provide a compressor inlet casing. The compressor inlet casing may include an inner bellmouth and a bearing housing. The bearing housing may include an integrally cast first half connected to the inner bellmouth about a horizontal center line and a cavity positioned between the inner bellmouth and the integrally cast first half. The cavity may accommodate thermal expansion of the bearing housing.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
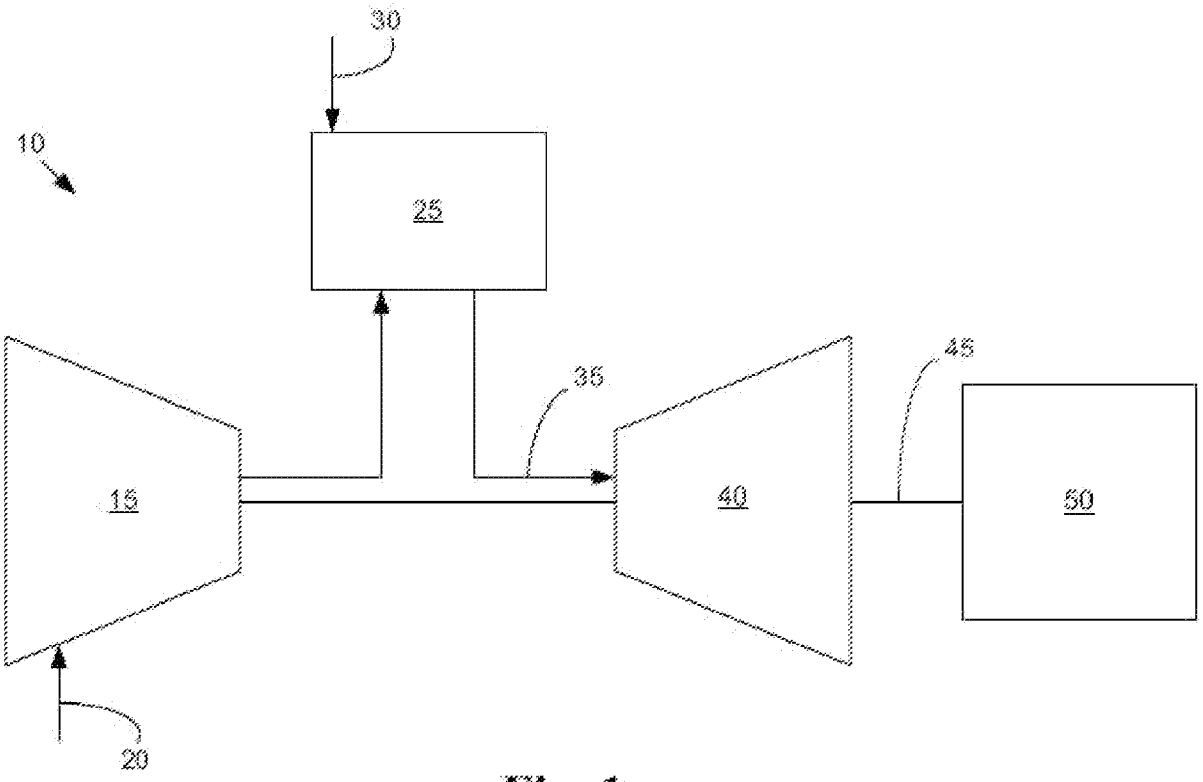
Fig. 1 Prior Art
FIG. 1 is a schematic view of a known gas turbine engine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor delivers the compressed flow of air 20 to a combustor 25. The combustor 25 mixes the compressed flow of air 20 with a compressed flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be anyone of a number of different gas turbine engines offered by General Electric Company of Schenectady, N.Y., including, but not limited to, those such as a heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
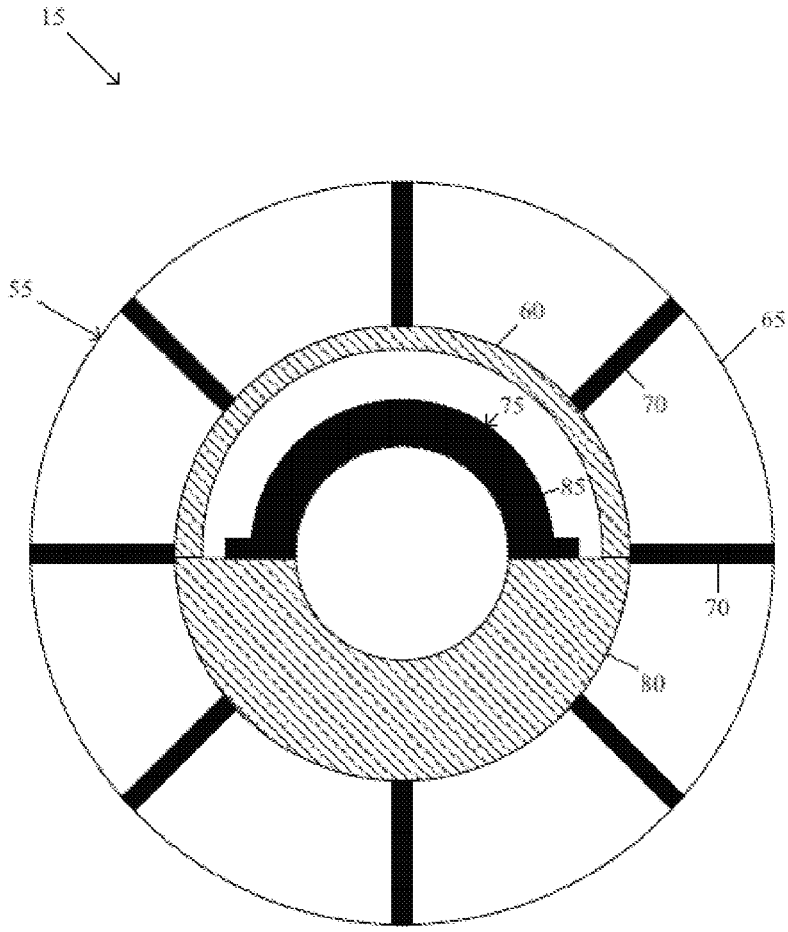
Fig. 2 Prior Art
FIG. 2 is a schematic view of a known compressor inlet casing.

FIG. 2 shows a schematic view of a known compressor inlet casing 55 for use with the compressor 15 and the like. The compressor inlet casing 55 may include an inner bellmouth 60 separated from an outer bellmouth 65 by a number of struts 70. The bellmouths 60, 65 allow for the passage of the flow of air 20 into the compressor 15. The compressor inlet casing 55 also may include a bearing housing 75. The bearing housing 75 may include an integrally cast lower or first half 80 and a separate upper second half 85. The integrally cast first half 80 is integrally cast with the inner bellmouth 60 as is described above. The bearing housing 75 supports a number of bearings therein (not shown) as well as the rotor shaft 45. Other components and other configurations may be used herein.

Figure 3:
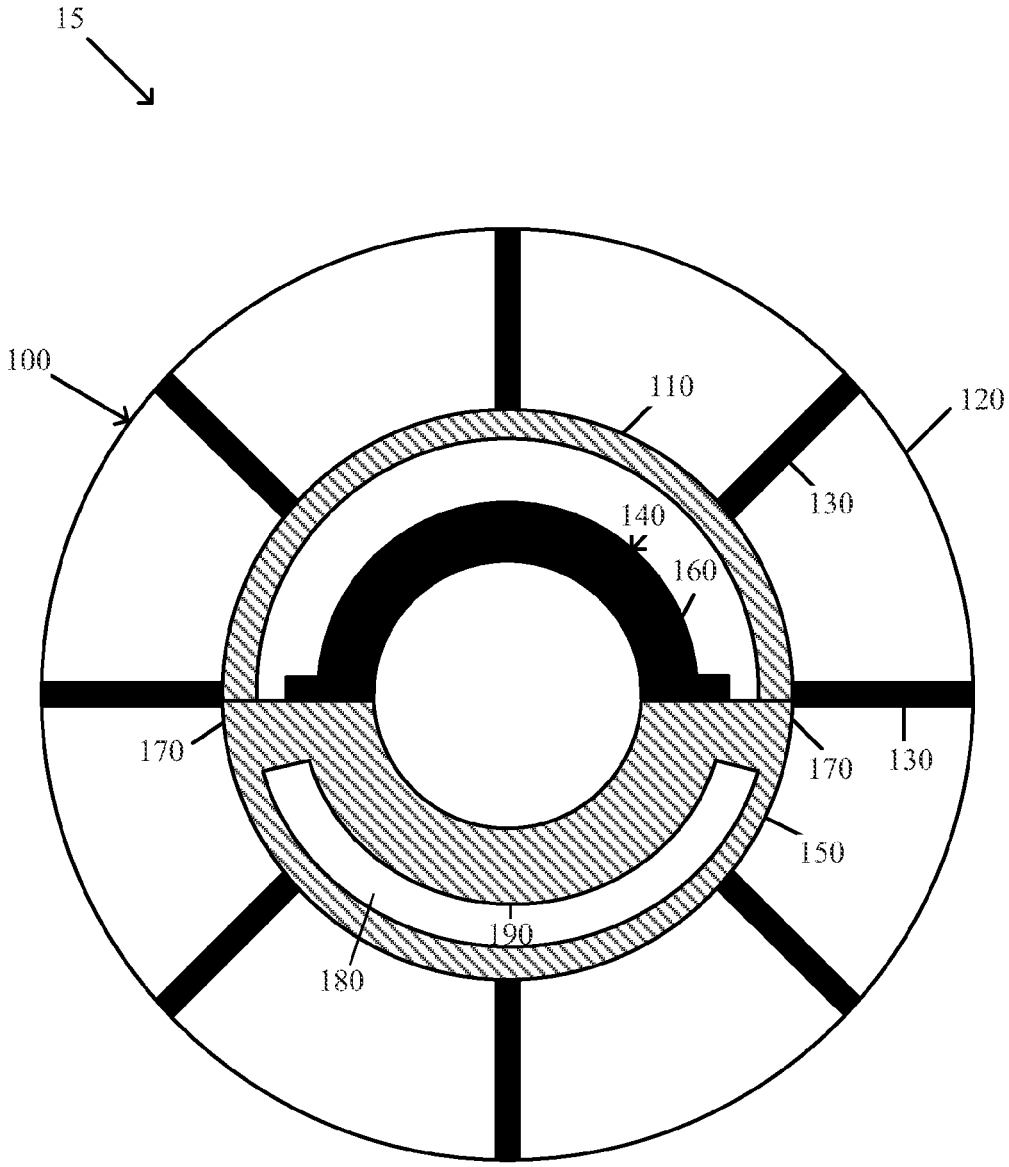
FIG. 3 is a schematic view of a compressor inlet casing as may be described herein.
Figure 4:
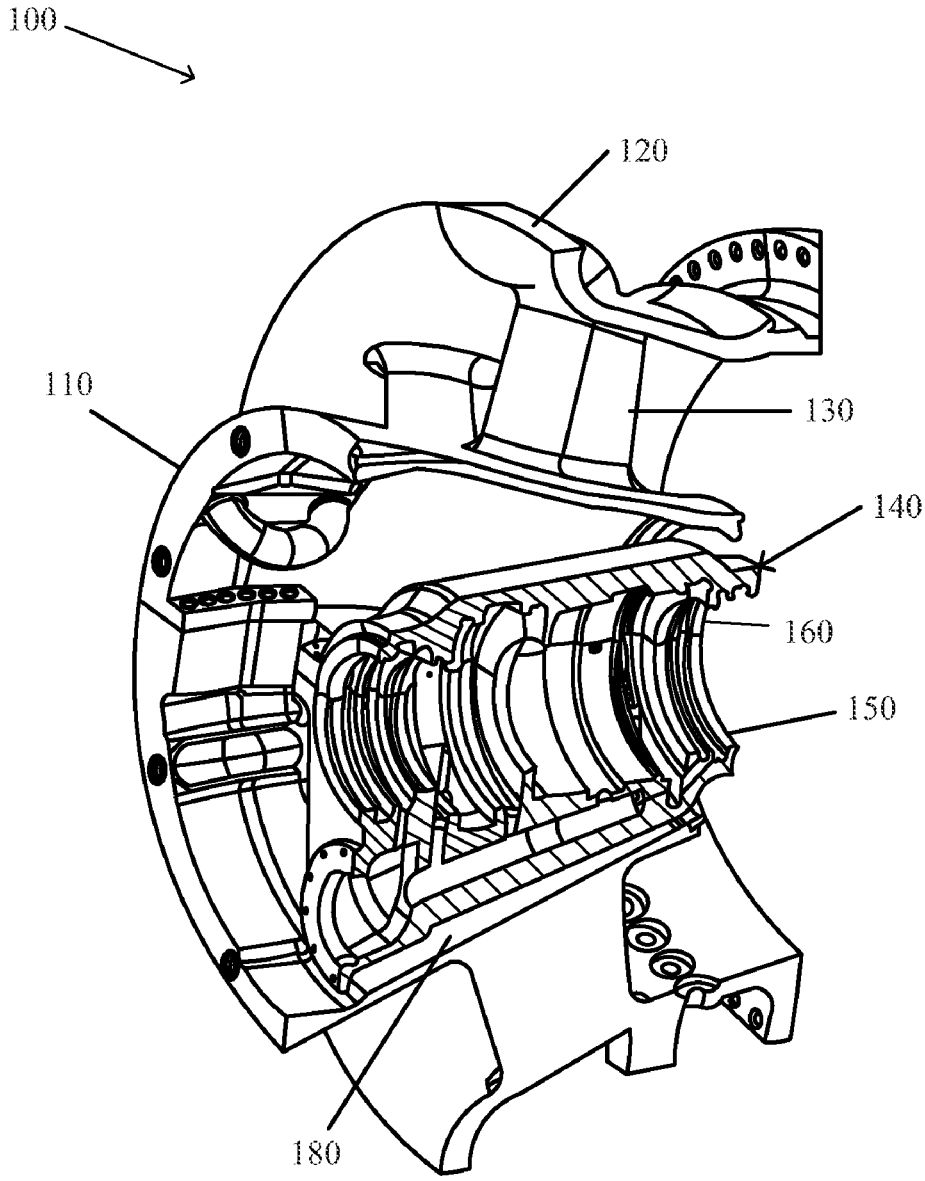
FIG. 4 is a side cross-sectional view of the compressor inlet casing of FIG. 3.
Figure 5:
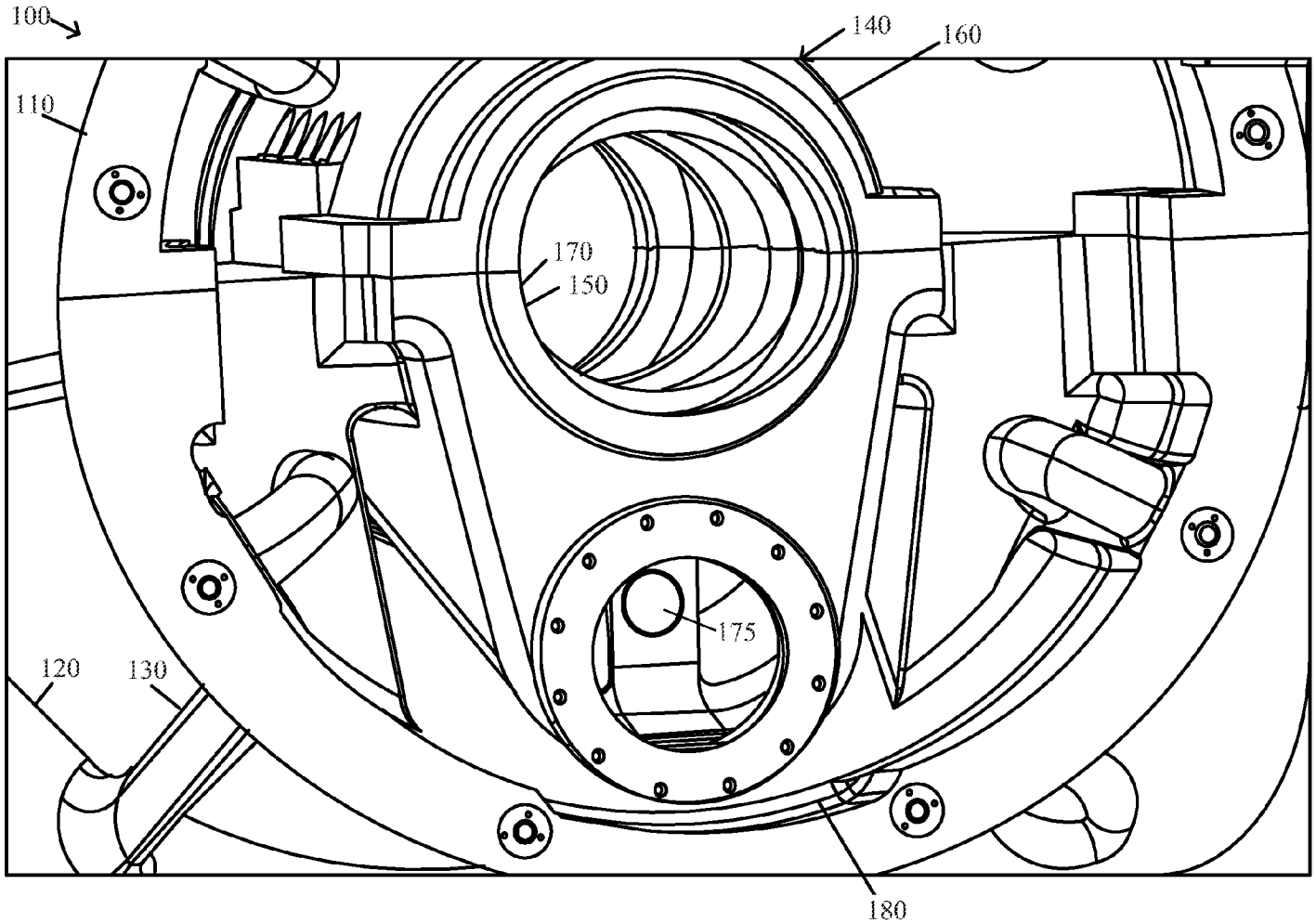
FIG. 5 is a perspective view of a portion of the compressor inlet casing of FIG. 3.

FIGS. 3-5 show a compressor inlet casing 100 as may be described herein. Similar to that described above, the compressor inlet casing 100 may include an inner bellmouth 110 separated from an outer bellmouth 120 by a number of struts 130. The inner bellmouth 110 may support a bearing housing 140 therein. The bearing housing 140 may include an integrally cast first half 150 and a separate second half 160. The integrally cast first half 150 may be connected to the inner bellmouth 110 at about a horizontal centerline 170. Other than the connection about the horizontal centerline 170, a cavity 180 may extend between the inner bellmouth 110 and the integrally cast first half 150 of the bearing housing 140. A lubricating oil conduit 175 may extend about the bearing housing 140. Other components and other configurations also may be used herein.

In use, the integrally cast first half 150 of the bearing housing 140 thus may be physically separated from the inner bellmouth 110 except about the horizontal centerline. The physical separation created by the cavity 180 thus allows the bearing housing 140 to thermally expand freely towards the inner bellmouth 110 about a bottom dead center position 190. Specifically, the cavity 180 ma be sized to accommodate thermal growth of the bearing housing 140. By allowing the bearing housing 140 to expand, the rotor shaft 45 may stay positioned about the centerline of the inner bellmouth 110. Given such, the eccentricity of the rotor shaft 45 may be minimized. Specifically, the impact of the heating of the bearing housing 140 by the lubricating oil and the like flowing therethrough may be minimized.

By avoiding eccentricities created by the thermal growth of the bearing housing 140, overall compressor clearances may be reduced so as to provide increased efficiency and overall performance. The compressor inlet casing 100 described herein thus provides such an improved performance but with the bearing housing 140 having the integrally cast first half 150 for overall lower costs.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A compressor inlet casing, comprising:
an inner bellmouth; and
a bearing housing;
wherein the bearing housing comprises an integrally cast first half connected to the inner bellmouth; and
a cavity positioned within the integrally cast first half of the bearing housing to accommodate thermal expansion of the integrally cast first half of the bearing housing.

2. The compressor inlet casing of claim 1, wherein the cavity is positioned about a bottom dead center of the bearing housing.

3. The compressor inlet casing of claim 1, wherein the bearing housing comprises a separate second half.

4. The compressor inlet casing of claim 1, further comprising an outer bellmouth surrounding the inner bellmouth.

5. The compressor inlet casing of claim 4, further comprising a plurality of struts connecting the inner bellmouth and the outer bellmouth.

6. The compressor inlet casing of claim 1, further comprising a rotor shaft extending through the bearing housing.

7. The compressor inlet casing of claim 1, wherein the cavity is sized to accommodate thermal expansion of the bearing housing.

8. The compressor inlet casing of claim 1, wherein the bearing housing comprises a lubricating oil conduit thereabout.

9. A method of operating a compressor, comprising:
integrally casting a first half of a bearing housing in a compressor inlet casing;
rotating a rotor shaft within the bearing housing;
extending a lubricating oil conduit about the bearing housing; and
thermally expanding the bearing housing within a cavity provided within the integrally cast first half of the bearing housing to accommodate thermal expansion of the integrally cast first half of the bearing housing.

10. The method of claim 9, wherein the step of integrally casting the first half of the bearing housing in the compressor inlet casing comprises connecting the first half of the bearing housing and the compressor inlet casing about a horizontal center line.

11. The method of claim 9, wherein the step of thermally expanding the bearing housing comprises thermally expanding the bearing housing without changing the position of the rotor shaft.

12. The method of claim 9, wherein the step of thermally expanding the bearing housing comprises thermally expanding the bearing housing without changing a lateral position of the rotor shaft.

13. The method of claim 9, wherein the compressor inlet casing includes a bellmouth for passage of air through the compressor.

14. The method of claim 9, further comprising the step of reducing compressor clearances.

15. A compressor inlet casing, comprising:
an inner bellmouth; and
a bearing housing;
wherein the bearing housing comprises an integrally cast first half connected to the inner bellmouth about a horizontal center line; and
a cavity positioned within the integrally cast first half of the bearing housing so as to accommodate thermal expansion of the bearing housing.

16. The compressor inlet casing of claim 15, wherein the cavity is positioned about a bottom dead center of the bearing housing.

17. The compressor inlet casing of claim 15, wherein the bearing housing comprises a separate second half.

18. The compressor inlet casing of claim 15, further comprising a rotor shaft extending through the bearing housing.

19. The compressor inlet casing of claim 15, wherein the bearing housing comprises a lubricating oil conduit thereabout.

* * * * *